United States Patent [19]

Bockwinkel

[11] Patent Number: 4,753,043

[45] Date of Patent: Jun. 28, 1988

[54] PIVOTALLY MOUNTED INSULATED GLASS DOOR ASSEMBLY WITH SELF-CONTAINED STRUCTURAL SUPPORT FRAME

[75] Inventor: Gerald J. Bockwinkel, Mundelein, Ill.

[73] Assignee: Ardco Inc., Chicago, Ill.

[21] Appl. No.: 941,297

[22] Filed: Dec. 11, 1986

[51] Int. Cl.[4] ..... E06B 3/00

[52] U.S. Cl. ..... 49/501; 49/504; 52/308; 52/780

[58] Field of Search ..... 49/501, 505, 504, 382; 52/308, 398, 400, 402, 780

[56] References Cited

U.S. PATENT DOCUMENTS

| | | | |
|---|---|---|---|
| 3,426,482 | 2/1969 | Mock | 49/501 |
| 3,629,972 | 12/1971 | Rehberg | 49/382 |
| 9,309,845 | 1/1982 | Schmidt | 49/501 |

FOREIGN PATENT DOCUMENTS

| | | | |
|---|---|---|---|
| 2614049 | 6/1977 | Fed. Rep. of Germany | 52/780 |
| 0077558 | 6/1980 | Japan | 52/780 |

*Primary Examiner*—Kenneth J. Dorner
*Assistant Examiner*—Gerald A. Anderson
*Attorney, Agent, or Firm*—Leydig, Voit & Mayer

[57] ABSTRACT

A refrigerator door assembly comprising a plurality of insulated doors each mounted for pivotal swinging movement about a vertical axis. The insulated doors each comprise a plurality of glass panes disposed in side-by-side relation with a structural frame at least partially interposed and contained between the glass panes for maintaining the panes in parallel relation with the sealed air space therebetween and for supporting the door for swinging opening and closing movement, without the necessity for a separate outer load carrying support frame as conventionally required. Each door has a trim portion formed of a structural foam that has insulating qualities so as to eliminate the necessity for electrical heating of the door for condensation control, while at the same time enhancing the structural rigidity of the door assembly.

45 Claims, 2 Drawing Sheets

PIVOTALLY MOUNTED INSULATED GLASS DOOR ASSEMBLY WITH SELF-CONTAINED STRUCTURAL SUPPORT FRAME

DESCRIPTION OF THE INVENTION

The present invention relates generally to glass doors, and more particularly, to insulated multi-pane glass doors which are hingedly mounted for swinging movement between open and closed positions, such as used in commercial refrigeration and freezer units.

Insulated glass doors used in commercial refrigeration and freezer units typically comprise an insulated glass unit consisting of two or more glass panes that are supported in spaced apart relation with the interior between the panes appropriately sealed. The spacing between the glass panes generally is achieved by tubular metal spacers disposed between the glass panes about the outer periphery thereof. To facilitate hinged mounting of the door within a cabinet frame and to provide a finished appearance to the door, a metal outer support frame conventionally is mounted about the perimeter of the insulated glass unit. Because such insulated glass doors comprise a plurality of glass panes, they are relatively heavy and require a sturdy and rugged outer frame for supporting the weight of the door and for withstanding the twisting and torsional forces incurred during repeated opening and closing of the door in commercial establishments. Since the outer frame generally must have a finished or decorative appearance and a specifically configured form, it typically is formed from an aluminum extrusion, which is relatively expensive and does not have the structural integrity of many lessor expensive materials, such as formed steel.

Such commercial refrigerator doors also are relatively expensive to manufacture. It is customary to first assemble the insulated glass unit which comprises the plurality of panes separated by the tubular spacers and sealed about the perimeter, and then the outer frame must be installed on the glass unit. One practice has been to hammer generally C-shaped extrusions onto the respective sides of the insulated glass unit, which requires accurate forming of the mitered corners of the outer frame members and establishing the squareness of the assembled frame. In another method of manufacture, a framing jig is utilized for forming the outer structural frame and the glass unit is then dropped into the frame. In this procedure, positive positioning means, such as shims, must be utilized to prevent the glass unit from shifting within the frame.

Moreover, because the outer support frame of such conventional doors is made of metal, it is highly heat conductive. Hence, when the door is used in refrigeration or freezer units, it frequently is necessary to include within the outer support frame of the door electrical heating cables for maintaining the portion of the frame exposed to the warmer ambient air at a sufficiently high temperature to prevent condensation build up. Such electrical heating means not only adds to the manufacturing cost of the door, but increases the operating cost of the refrigeration unit with which the door is used.

Accordingly, it is an object of the present invention to provide an insulated glass door assembly which has a relatively simple construction and lends itself to more economical manufacture.

Another object is to provide an insulated glass door assembly as characterized above which comprises an insulated glass unit with a plurality of glass panes, but does not require a separate outer load carrying support frame.

A further object is to provide an insulated glass door assembly of the above kind which can be effectively used in refrigeration and freezer units without the necessity for electrically heating the perimeter of the door.

Yet another object is to provide an insulated glass door assembly which has a non-metallic, outer lightweight decorative trim portion that can be inexpensively formed and which has insulating qualities. A related object is to provide such an insulated glass door assembly in which the outer decorative trim portion has a one piece seamless construction which assists in preventing the infiltration of air and moisture into the interior of the insulated glass unit.

Still a further object is to provide an insulated glass door assembly as characterized above which has improved structural integrity. A related object is to provide such an insulated glass door assembly which permits utilization of relatively inexpensive formed steel as the structural frame members for hinged mounting of the door.

Yet a further object is to provide a door assembly of such type in which the glass panes add to the structural integrity of the door assembly.

Other objects and advantages of the invention will be more readily apparent upon reading the following description of a preferred embodiment of the invention and upon reference to the accompanying drawings wherein.

Figure 3:
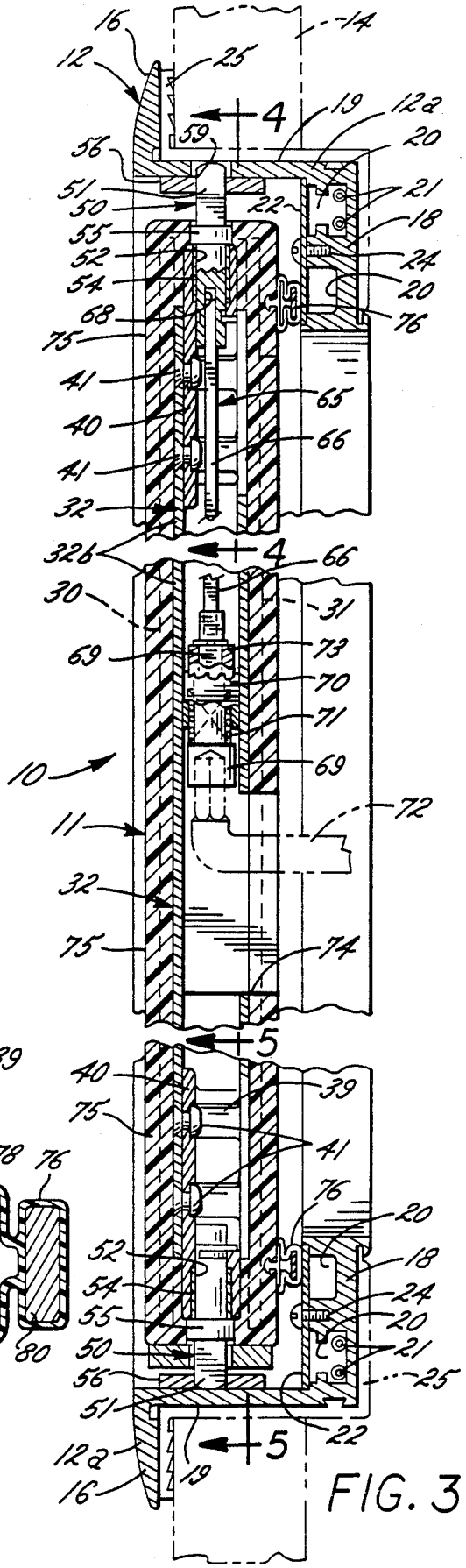
FIG. 3 is an enlarged vertical section illustrating the hinged mounting of one of the doors, taken in the plane of line 3—3 in FIG. 1.
Figure 4:
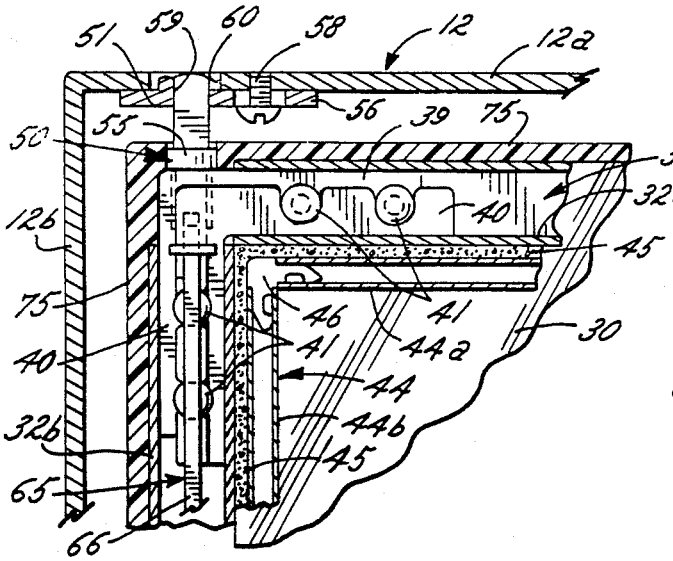
Figure 7:
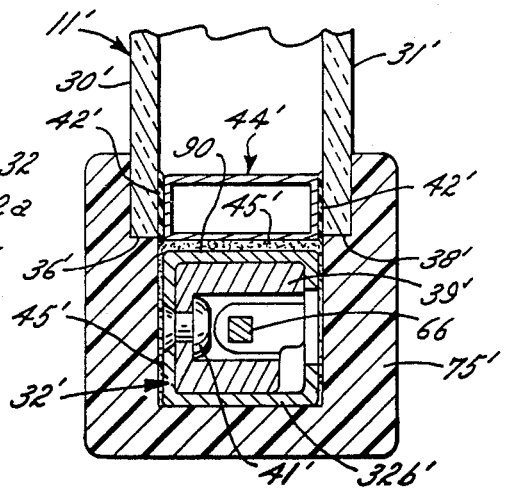
Figure 5:
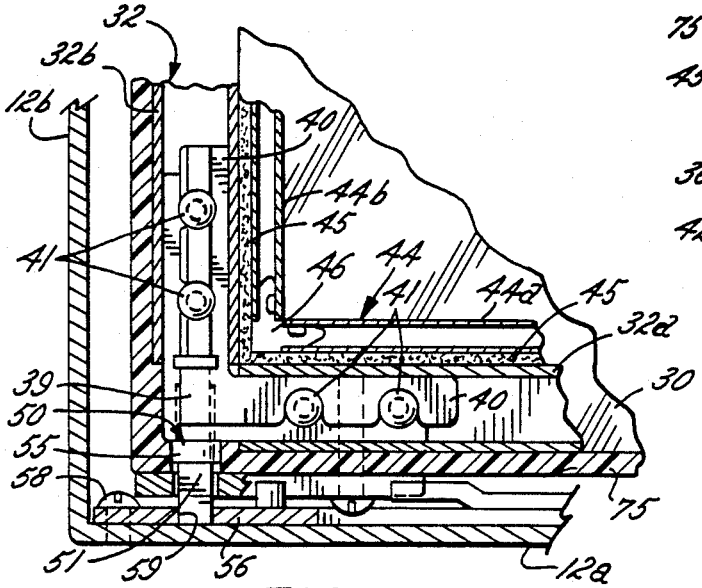
Figure 8:
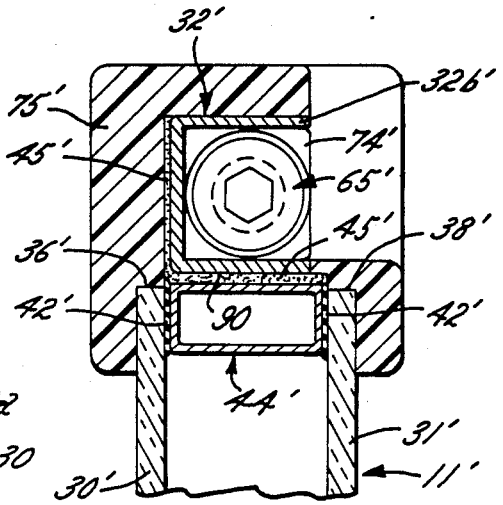
Figure 6:
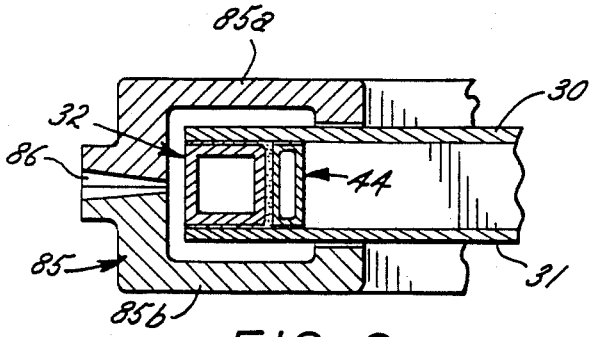
Figure 9:
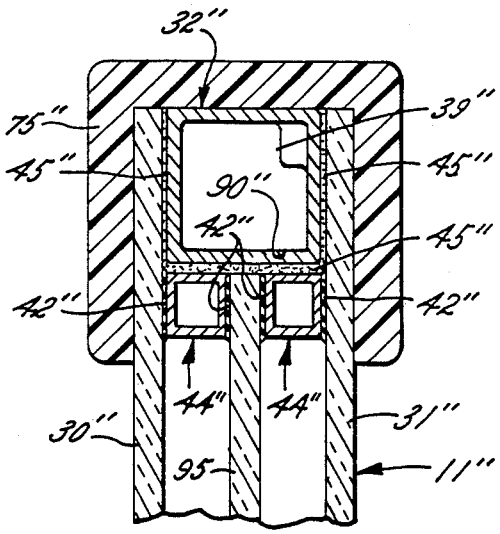

FIGS. 4 and 5 are enlarged fragmentary sections of the hinge mounting for the door taken in a planes of lines 4—4 and 5—5, respectively, in FIG. 3;

FIG. 6 is a partially diagrammatic illustration of a mold arrangement utilized in forming a seamless foam molded outer trim portion about the perimeter of the door;

FIGS. 7 and 8 are fragmentary sections showing an alternatived side construction for the door; and FIG. 9 is a fragmentary section showing a further alternative embodiment of door construction according to the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

Referring now more particularly to FIGS. 1-5 of the drawings, there is shown an illustrative refrigerator door assembly 10 comprising a plurality of insulated glass doors 11 mounted for swinging movement in a cabinet frame 12, which in turn is mounted within the opening of a front wall 14 (FIG. 2) of a refrigerator cabinet or the like. It will be understood that the door assembly 10 is particularly adapted for use in free standing refrigerator cases or built-in coolers or cabinets of the type used in supermarkets and other retail stores to display merchandise that requires refrigeration.

The cabinet frame 12 extends about the periphery of the opening in the wall 14 and includes upper and lower horizontal frame members 12*a*, and side frame members 12*b* extending vertically therebetween at opposed ends thereof. The cabinet frame 12 includes one or more mullions 15 that extend vertically between the upper and lower frame members 12*a* in a conventional manner to provide rigidity for the frame 12 and define a sealing surface against which the free swinging sides of the doors 11 engage when in a closed condition.

The cabinet frame members 12*a*, 12*b* preferably are in the form of extrusions made of aluminum or other suitable metal material. The illustrated frame members 12*a*, 12*b*, as shown in FIG. 3, have a generally Z-shaped configuration comprising a front or outer flange 16, a rear or inner flange 18, and a web 19 extending therebetween. The front and rear flanges 16, 18 project in opposite directions, generally at right angles to the web 19. The rear flange 18 of each extrusion in this instance is of a hollow construction so as to define a pair of channels 20 which are adapted to receive one or more electrical heating cables 21 for the purpose of maintaining the extrusions at a temperature sufficient to avoid a build up of condensation. Each rear flange 18 is provided with a cover plate 22 to close the channels 20, the cover plate 22 in this case being removably secured to the flange 18 by screws 24. A generally Z-shaped strip 25, preferably made of plastic or other insulating material, may be interposed between each of the outer frame members 12*a*, 12*b* and the cabinet wall 14. It will be understood that while the illustrated doors 11 are shown as being mounted in the cabinet frame 12, which in turn is disposed within the opening of the cabinet, alternatively, the doors may be hung on brackets affixed to the cabinet in close relation to the opening.

Figure 1:
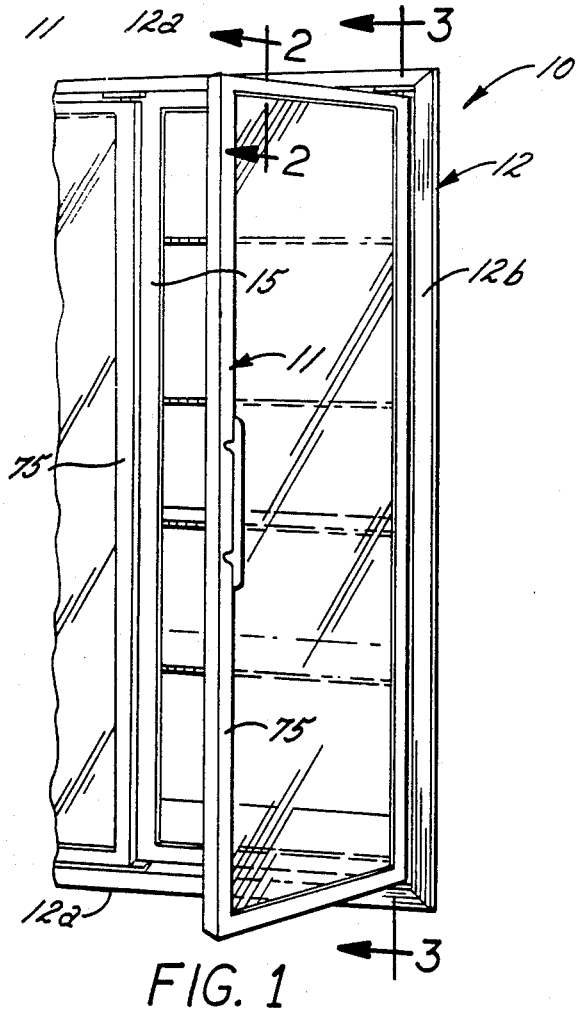
FIG. 1 is a perspective of a refrigerator door assembly having a plurality of hingedly mounted insulated glass doors embodying the present invention.
Figure 2:
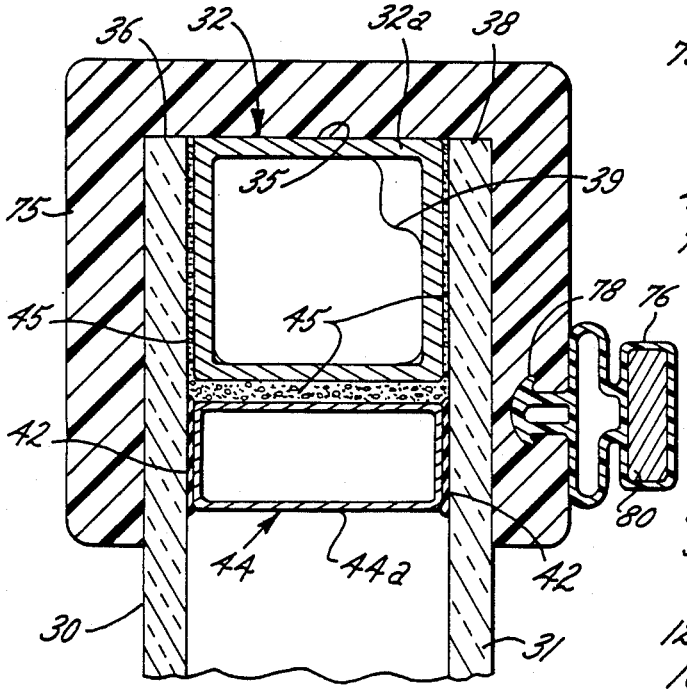
FIG. 2 is an enlarged fragmentary section of one of the doors taken in the plane of line 2—2 in FIG. 1.

In accordance with the invention, the insulated glass doors each comprise a plurality of glass panes disposed in side-by-side relation and a structural frame at least partially interposed and contained between adjacent glass panes for supporting the door for pivotal movement within the cabinet frame. The illustrated doors 11, as depicted in FIGS. 1–5, each comprise a pair of glass panes 30, 31 disposed in parallel space side-by-side relation and a structural frame 32 comprising top and bottom elongated tubular members 32*a* and side tubular members 32*b*, the tubular frame members 32*a*, 32*b* being disposed in a rectangular arrangement between the panes 30, 31 about the peripheral edges thereof. Since the illustrated doors 11 each are of substantially identical construction, only one need be described in detail. The tubular structural frame members 32*a*, 32*b* may be made of relatively inexpensive formed steel, and in this instance, are disposed such that an outer peripheral side 35 of each of the frame members 32*a*, 32*b* is substantially in the plane of the adjacent peripheral edges 36, 38 of the glass panes 30, 31, as best shown in FIG. 2. The panes 30, 31 preferably are formed of tempered glass so as to prevent splintering in the event of breakage, as well as to enhance the structural rigidity of the door assembly, as will become apparent.

For coupling abutting ends of the tubular structural frame members 32*a*, 32*b* together, corner keys 39 are provided which each have a pair of perpendicularly disposed legs 40 adapted for insertion into abutting ends of the tubular structural members 32*a*, 32*b* (FIGS. 4 and 5). The structural members 32*a*, 32*b* may be secured to the corner key legs 40 by rivets 41, or other suitable fasteners, as shown in FIG. 3.

To ensure that the interior space between the glass panes of the door remains in a sealed condition during use of the door even if the structural frame members 32*a*, 32*b* might experience slight deformation or flexing as a result of torsional forces exerted on the frame, a relatively thin gauge metal spacer 44 is disposed between the glass panes 30, 31 adjacent the inner side of the structural frame members 32*a*, 32*b* and a sealant 42, such as polyisolbutylene, is provided between the sides of the spacer 44 and the adjacent glass panes 30, 31 for establishing a primary vapor seal. The spacer 44 comprises a plurality of tubular members 44*a*, 44*b* and the abutting ends of the tubular spacer members 44*a*, 44*b*, like the structural frame members 32*a*, 32*b*, are joined together by suitable corner keys 46 so as to form a rectangular configuration within the rectangular configured structural frame 32. A layer 45 of a flexible sealant, such as polysulfide, is provided between the spacer members 44*a*, 44*b* and the frame members 32*a*, 32*b* and between the sides of the frame members 32*a*, 32*b* and the adjacent glass panes 30, 31.

For supporting the insulated glass door 11 for swinging movement about the axis of one of the side structural members 32*b*, hinge assemblies 50 are provided at opposite ends of the side structural member 32*b*, as best shown in FIGS. 3–5. The hinge assemblies 50, which may be of a type similar to that disclosed in U.S. Pat. No. 3,629,972, assigned to the same assignee as the present application, each include a hinge pin 51 rotatably received in a bore 52 of a respective corner key 39 (FIG. 3). An antifriction bushing 54 made of nylon or other suitable anti-friction material may be interposed between the corner key bore 52 and the hinge pin 51 to facilitate relative rotation of the hinge pin. The hinge pins 51 each have an outwardly projecting end, preferably of square or rectangular cross section. The outwardly projecting end of the hinge pin 51 at the upper end of the door extends in an upwardly directed fashion, while the outwardly projecting end of the hinge pin 51 at the lower end of the door extends downwardly. The hinge pins 51 each are formed with an enlarged diameter shoulder 55 intermediate its ends that bears against the outermost end of the respective corner key 39.

For receiving the outwardly projecting end of the each hinge pin 51, the hinge assemblies 50 each include a plate 56 that is fixed to the web portion 19 of the cabinet frame 12 by screws 58 (FIG. 5) and is formed with an aperture 59 of a shape complimentary to the shape of the hinge pin. The hinge pin 51 at the top of the door in this instance projects through the aperture 59 in the plate 56 and into an aperture 60 formed in the web 19 of the top cabinet frame member 12*a*. The plates 56 may be of a type shown in, assigned to the same assignees as the present application, U.S. Pat. No. 4,416,086, which are selectively positionable on the cabinet frame for permitting selected adjustment of the swing axis of the door. Because of the non-circular innerfitting relation between the hinge pins 51 and the respective plate apertures 59, the support frame 12 of the door is pivotable with respect to the hinge pins 51, thereby permitting hinged swinging movement of the door 11 relative to the cabinet frame 12.

For the purpose of biasing the door 11 into closed engagement with the cabinet frame 12 in a self-closing manner after it has been opened, the hinge pin at the upper end of the door is provided with a door closure mechanism 65 (FIGS. 3 and 4). The door closure mechanism 65 includes a torsion rod 66 connected between the upper hinge pin 51 and the structural frame member 12 of the door. The torsion rod 66, which may be square in cross section, has one end received in a square socket or opening 68 formed in the upper hinge pin 51 and the other end secured to a rotatable head 69 formed with a socket on its underside for receiving a suitable wrench 72, such as shown in phantom in FIG. 3. To permit access of the wrench 72 to the underside of the rotatable head 69, an aperture 74 is formed in the rear side of the door which extends into the tubular structural frame member 32*b*. The rotatable head 69 extends through and is rotatable relative to a non-rotatable block 70 that preferably is rectangular in cross-section and disposed within the tubular structural frame member 32*b* for relative longitudinal movement. The block 70 is formed with ratchet teeth on its upper end and is biased by a spring 71 into engagement with ratchet teeth of a hub 73 affixed to the torsion rod 66. Rotation of the head 69 by the wrench 72 will rotate the hub 73 and torsion rod 66 relative to the non-rotatable block 70, with the block 70 being forced downwardly against the force of the spring 69 to permit passage of successive ratchet teeth until the desired pre-stressing of the torsion rod 66 achieved to ensure closure of the door. Once adjusted, the ratchet teeth of the hub 73 and non-rotatable block 70 will retain the torsion rod in the pre-stressed condition.

In keeping with the invention, the insulated door 11 has a non-metallic, lightweight, outer decorative trim portion 75 that can be inexpensively formed and which has insulating qualities that tend to prevent heat transfer between the warm and cold temperature sides of the door, and thus, tend to resist the undesirable build up of condensation on the door, without the necessity for electric heating means within the door. The illustrated trim portion 75 preferably is molded of a foam plastic material, such as structural polyurethane foam sold by Mobay Chemical Company under the name Baydur, so as to substantially encapsulate the entire outer periphery of the door. The trim portion 75, which in this case has a generally C-shaped cross sectional configuration, may be formed of any desired decorative configuration that covers the structural frame 32 and spacer 44 from view and gives the door an attractive finished appearance. As is known in the art, such structural foam may be formed with a solid, non-porous skin and a low-density microcellular core so as to combine high strength with light weight. The trim portion 75 bonds and adheres to the peripheral edges of the door so as to both form the finished trim for the door, as well as enhance the rigidity of the door assembly. The trim portion 75 further protects the peripheral edges of the door and cushions the door against damage from impact by other objects. Since the trim portion 75 may be formed of a seamless configuration, it also assists in preventing the infiltration of air and moisture into the interior of the insulated glass door. Moreover, since the trim portion has a cellular core, it has relatively low heat conductivity. Hence, contrary to conventional refrigerator door assemblies with metallic support outer frames, the trim portion has relatively low heat conductivity and is less susceptible to condensation and frost buildup, even without electrical heating means within the door.

For providing a seal between the door 11 and the cabinet frame 12 when the door is in a closed position, a gasket or sealing strip 76 may be secured to the trim portion 75 about the inner side of the door. The illustrated sealing strip 76 is formed with a generally T-shaped anchor portion 78 that is positively retained within in the trim portion 75 (FIG. 2). The sealing strip 76 preferably contains magnets 80 for creating a magnetic attraction with the cabinet frame cover plate 22, which may be made of stainless steel or other suitable magnetic material, so as to provide a firm sealing pressure between the gasket 76 and the cabinet frame 12.

It will be appreciated by one skilled in the art that the insulated door 11 lends itself to automated and more efficient manufacture. The structural frame 32, spacer 44, and glass panes 30, 31 may be assembled into an insulated glass unit by automated means currently available for assembling insulated glass units. In contrast to the labor intensive and relatively expensive procedure of assembling an outer metal structural frame about such glass package, as is conventionally required, the non-metallic trim portion 75 may be efficiently molded about the perimeter of the glass unit, as diagrammatically depicted in FIG. 6. The insulated glass unit comprising the assembled structural frame 32, spacer 44, and glass panes 30, 31 is positionable into a mold 85 comprising a pair of cavity sections 85*a*, 85*b* and polyurethane form or other suitable material may be injected into the mold through an inlet 86 to encompass the perimeter of the glass unit and form the trim portion 75 with the desired decorative configuration. As is known in the art, structural polyurethane foam, such as sold by Mobay Chemical Company under the name Baydur, can be produced by chemically reacting polyol and an isocyanate and injecting such reacting mixture at atmospheric pressure into a mold. Depending upon the desired density of the molded part, the mold can be filled to between about 20% to 60% of its capacity, and the reaction mixture then expends to fill the mold cavity. The pressure developed during forming produces a solid, non-porous skin of the molded part and a relatively low density microcellular core.

The insulated glass door 11 has significant structural rigidity and will withstand rigorous use required of such doors when utilized in commercial refrigeration equipment. Since the door 11 is hingedly mounted on its structural frame 32, which can be made of sturdy formed steel members, the frame will absorb and withstand most forces exerted on the door during usage. Because the structural frame 32 is sandwiched between tempered glass panes 30, 31, the glass panes further enhance the structural rigidity of the door, as does the structural foam trim portion 75.

While the trim portion 75 has been shown as being mold formed of structural foam or like material directly about the door to form a seamless outer perimeter, it will be appreciated that the trim portion could be extruded or molded into lineal sections which are then adhesively applied to the door. Alternatively, plastic trim pieces could be employed which are snapped onto the perimeter of the glass unit to provide the desired finished trim. Still another alternative would be to simply use a decorative tape about the perimeter of the door. It will further be appreciated that while the structural frame members have been described as being made of formed steel, tubular frame members of other metal material could be used, such as aluminum. Such frame members need not have a decorative finish or the detailed configuration typical of conventional commercial refrigerator door frames which encompass the outer perimeter of the door, and thus, can be more economically produced.

Referring now to FIGS. 7 and 8, there is shown an alternative embodiment of the insulated glass door in which at least one of the side structural members is disposed in outboard relation to the adjacent peripheral edges of the glass panes to facilitate access thereto. Items similar to those described previously have been given similar reference numerals with the distinguishing prime (') added. In this instance, the side structural frame member 32*b*' which forms the pivot axis for the door 11' is disposed such that an innermost side 90 of the side frame member 32*b*' is disposed substantially in the plane of the adjacent edges 36', 38' of the glass panes 30', 31' such that the access opening 74' into the structural member 32*b*' to permit adjustment of the torque of the door closure mechanism 65' may be made without the necessity for providing an aperture through the rearwardmost glass pane 31'. It will be appreciated that since the top and bottom structural frame members and the side structural frame member on the free swinging side of the door preferrably are contained between the glass panes, as previously described, the door 11' will have significant rigidity, enhanced both by the tempered glass panes 30', 31' and the molded trim portion 75'. Alternatively, the side structural frame member on the free swinging side of the door may be similarly disposed in outboard relation to the plane of the peripheral edges of the glass panes to facilitate securement of a handle for the door directly to the structural frame 32 of the door without providing apertures in the glass panes.

Referring now to FIG. 9 there is shown still a further alternative embodiment of the door construction according to the present invention wherein items similar to those previously described have been given similar reference numerals with the distinguishing double prime (") added. In this embodiment, the door 11" comprises three glass panes, namely inner and outer panes 30", 31" and an intermediate pane 95. The structural frame 32" is interposed between the inner and outer panes 30", 31" and is encapsulated in molded trim portion 75" in a manner similar to that described in connection with the embodiment of FIGS. 1–5. In this case, the intermediate pane 95 is of slightly smaller size than the inner and outer panes 30", 31", with the peripheral edges of the intermediate pane 95 being adjacent inner surfaces 90" of the frame members of the structural frame 32". To maintain the intermediate pane in appropriately spaced relation to the inner and outer panes 30", 31" and to more reliably seal the interior air spaces between the panes, relatively thin guage tubular spacers 44" are positioned on each side of the intermediate pane 95 in interposed relation between the respective inner and outer panes 30", 31". A primary sealant 42", such as polyisolbutylene, is provided between the sides of the spacer 44" and the adjacent surfaces of the glass panes 30", 31", 95. A layer 45" of a flexible sealant material, such as polysulphide, is provided between the structural frame 32" and the spacers 44" and peripheral edges of the intermediate pane 95 and between the sides of the frame 32" and The adjacent glass panes 30", 31".

From the foregoing, it will be seen that the insulated glass door of the present invention has a relatively simple construction and lends itself to relatively economical manufacture. While comprising an insulated glass unit with a plurality of glass panes, the door does not require a separate outer load carrying support frame, as has been conventionally utilized. Yet the door has improved structural integrity, while permitting utilization of relatively inexpensive formed steel as the structural support for hinged mounting of the door. Moreover, the door may have a molded, foam-formed trim portion that can be inexpensively applied to the glass unit and which has insulating qualities so as to eliminate the necessity for electrical heating of the door for frost control, while at the same time enhancing the structural rigidity of the assembly.

What is claimed is:

1. A refrigerator door assembly mountable for swinging movement relative to an opening of a refrigeration cabinet comprising a plurality of glass panes disposed inside-by-side relation with an air space therebetween and a structural frame interposed between said glass panes, said structural frame including a plurality of interconnected metal tubular frame members disposed adjacent the peripheral edges of said glass panes, means sealing said air space from the outside ambient environment, and hinge means extending into at least one of said tubular frame members for supporting said structural frame for swinging movement relative to said cabinet opening about a vertical pivot axis.

2. The refrigerator door assembly of claim 1 including a cabinet frame mountable within said cabinet opening, and said hinge means being supported by said cabinet frame.

3. The refrigerator door assembly of claim 1 including corner key elements connecting the ends of said tubular frame members together to form a generally rectangular configured structural frame.

4. The refrigerator door assembly of claim 3 in which said structural frame includes a pair of vertical tubular members connected at opposite ends by a pair of horizontal tubular members, and said pivot axis is coaxial with one of said vertical tubular structural members.

5. The refrigerator door assembly of claim 1 in which said sealing means seals said structural frame members to interior surfaces of said glass panes.

6. The refrigerator door assembly of claim 1 in which said structural frame members are made of formed steel.

7. The refrigerator door assembly of claim 1 including corner key elements connecting adjacent ends of said tubular frame members, and said hinge means includes a hinge pin associated with vertically aligned corner key elements on one side of said door assembly.

8. The refrigerator door assembly of claim 7 in which said hinge pins extend outwardly from the top and bottom of said structural frame, and means mountable on said cabinet defining apertures for receiving said hinge pins.

9. The refrigerator door assembly of claim 1 including a plurality of interconnected spacer members each disposed adjacent an inner side of a respective one of said structural frame members, and means sealing said spacer members to the interior surfaces of said glass panes.

10. The door assembly of claim 9 including a flexible sealant material between each said spacer member and the adjacent structural frame member and between said structural frame members and said glass panes.

11. The refrigerator door assembly of claim 1 in which said glass panes are made of tempered glass.

12. The refrigerator door assembly of claim 1 in which said structural frame members includes a pair of horizontal tubular members connected by a pair of vertical tubular members to form a generally rectangular configured frame.

13. The refrigerator door assembly of claim 12 in which each of said frame members has an outer side disposed substantially in the plane of the adjacent peripheral edges of said glass panes.

14. The refrigerator door assembly of claim 1 in which said door assembly has two glass panes.

15. The refrigerator door assembly of claim 1 in which said door assembly has inner and outer glass panes and at least one intermediate pane disposed between said inner and outer panes.

16. The refrigerator door assembly of claim 15 in said structural frame is disposed between said inner and outer glass panes.

17. The refrigerator door assembly of claim 16 in which said intermediate glass pane is of smaller size than said inner and outer glass panes and has peripheral edges in close relation to inner sides of said structural frame members.

18. The refrigerator door assembly of claim 17 including spacers disposed between said intermediate glass panes and the immediately adjacent glass pane.

19. The refrigerator door assembly of claim 18 in which said spacers each comprise a plurality of tubular members interconnected to form a generally rectangular configuration.

20. The refrigerator door assembly of claim 19 in which said structural frame members and said spacer members each are made of metal, and said spacer members are of relatively thinner gauge.

21. The refrigerator door assembly of claim 20 including a sealant layer between said structural frame members and said spacer members.

22. The refrigerator door assembly of claim 21 in which said sealant layer is disposed between said structural frame members and the outer peripheral edges of said intermediate glass pane.

23. The refrigerator door assembly of claim 1 including a non-metallic trim portion surrounding the outer periphery of said glass panes and said structural frame members.

24. The refrigerator door assembly of claim 23 in which said trim portion is made of plastic.

25. The refrigerator door assembly of claim 24 in which said trim portion is made of molded foam material.

26. The refrigerator door assembly of claim 24 in which said trim portion is made of molded structural foam.

27. The refrigerator door assembly of claim 26 including a gasket strip fixed to said trim portion and extending about the perimeter of said door for providing a seal between said door and cabinet frame when said door is in a closed position.

28. The refrigerator door assembly of claim 23 in which said trim portion has a generally C-shaped cross section encapsulating the outer periphery of said glass panes and said structural frame members.

29. The refrigerator door assembly of claim 28 in which said trim portion has a one-piece seamless construction.

30. A refrigerator door assembly mountable for swinging movement relative to an opening of a refrigeration cabinet comprising a plurality of glass panes disposed in side-by-side spaced apart relation with an air space therebetween and a structural frame including a plurality of interconnected metal tubular frame members disposed adjacent the peripheral edges of said glass panes, means sealing said air space from the outside ambient environment, a one-piece non-metallic trim portion encapsulating the outer periphery of said glass panes and said frame members, and hinge means extending into at least one of said tubular frame members for supporting said structural frame for swinging movement relative to said cabinet opening.

31. The refrigerator door assembly of claim 30 including a cabinet frame mountable within said cabinet opening, and said hinge means being supported by said cabinet frame.

32. The refrigerator door assembly of claim 30 in which said structural frame is at least partially contained between said glass panes.

33. The refrigerator door assembly of claim 32 in which said insulated door is mountable for swinging movement about a vertical pivot axis.

34. The refrigerator door assembly of claim 30 in which said structural frame includes a pair of verticle tubular tubular members connected at opposite ends by a pair of horizonal tubular members, and said pivot axis is coaxial with one of said vertical tubular structural members.

35. The refrigerator door assembly of claim 34 in which said structural frame members are made of formed steel.

36. The refrigerator door assembly of claim 30 including corner key elements connecting adjacent ends of said structural frame members, and said hinge means includes a hinge pin associated with vertically aligned corner key elements on one side of said door.

37. The refrigerator door assembly of claim 30 in which said hinge pins extend outwardly from the top and bottom of said structural frame, and means on said cabinet defining apertures for receiving said hinge pins.

38. The refrigerator door assembly of claim 30 including a plurality of interconnected spacer members each disposed adjacent an inner side of a respective one of said structural frame members and said sealing means includes means sealing said spacer members to the interior surfaces of said glass panes and a flexible sealant layer between each said spacer member and the adjacent structural frame member, and between said structural frame members and said glass panes.

39. The refrigerator door assembly of claim 30 in which each said frame members has an outer side disposed substantially in the plane of the adjacent peripheral edges of said glass panes.

40. The refrigerator door assembly of claim 30 in which said structural frame members include a pair of horizontal tubular members connected by a pair of vertical tubular members to form a generally rectangular configured frame, said horizontal structural frame members being interposed between said glass panes with an outer peripheral side thereof substantially in the plane of the adjacent outer peripheral edges of said glass panes, and at least one of said vertical structural frame members being disposed with its outer side in outwardly spaced relation of the plane of the adjacent outer peripheral edges of said glass panes.

41. The refrigerator door assembly of claim 38 in which said structural frame members and said spacer members each are made of metal, and said spacer members are of relatively thinner gauge.

42. The refrigerator door assembly of claim 30 in which said trim portion is made of plastic.

43. The refrigerator door assembly of claim 42 in which said trim portion is made of structural foam material.

44. The refrigerator door assembly of claim 43 in which said trim portion has a generally C-shaped cross section encapsulating the outer periphery of said glass panes and said structural frame members.

45. The refrigerator door assembly of claim 44 in which said trim portion has a one-piece seamless construction.

* * * * *